United States Patent [19]

Possinger

[11] Patent Number: 4,542,929

[45] Date of Patent: Sep. 24, 1985

[54] ARTICULATING CLAM TYPE GRAPPLE FOR A BACKHOE

[76] Inventor: Warren K. Possinger, 14433-106th Pl. NE., Bothell, Wash. 98011

[21] Appl. No.: 529,024

[22] Filed: Sep. 1, 1983

[51] Int. Cl.[4] ..... B66C 3/16

[52] U.S. Cl. ..... 294/88; 37/186; 294/68.23; 414/739

[58] Field of Search ..... 294/70, 86 R, 88, 106; 37/183 R, 186, 187; 414/624, 732, 738–740

[56] References Cited

U.S. PATENT DOCUMENTS

| | | | |
|---|---|---|---|
| 3,413,029 | 11/1968 | Donovan | 294/88 X |
| 3,759,564 | 9/1973 | Seaberg | 294/88 |
| 3,877,743 | 4/1975 | Johnson | 294/88 |
| 3,914,886 | 10/1975 | Berg et al. | 294/88 X |
| 3,920,137 | 11/1975 | McCain | 294/88 X |
| 3,966,249 | 6/1976 | Lindqvist | 294/88 |
| 4,426,110 | 1/1984 | Mitchell et al. | 294/88 |

*Primary Examiner*—Johnny D. Cherry

*Attorney, Agent, or Firm*—Cole, Jensen & Puntigam

[57] ABSTRACT

Articulating clam-type grapple for a backhoe which includes a mounting head member for connecting to the backhoe dipper stick and tool cylinder. A grapple mounting assembly is pivotally attached to the head mechanism which enables both grapple jaws to be moved to open and closed positions. The mounting assembly includes a hydraulic motor and gear box combination for rotating the grapple such that the grapple and the jaws thereof are positively controlled in all directions of movement.

12 Claims, 6 Drawing Figures

FIG. 2
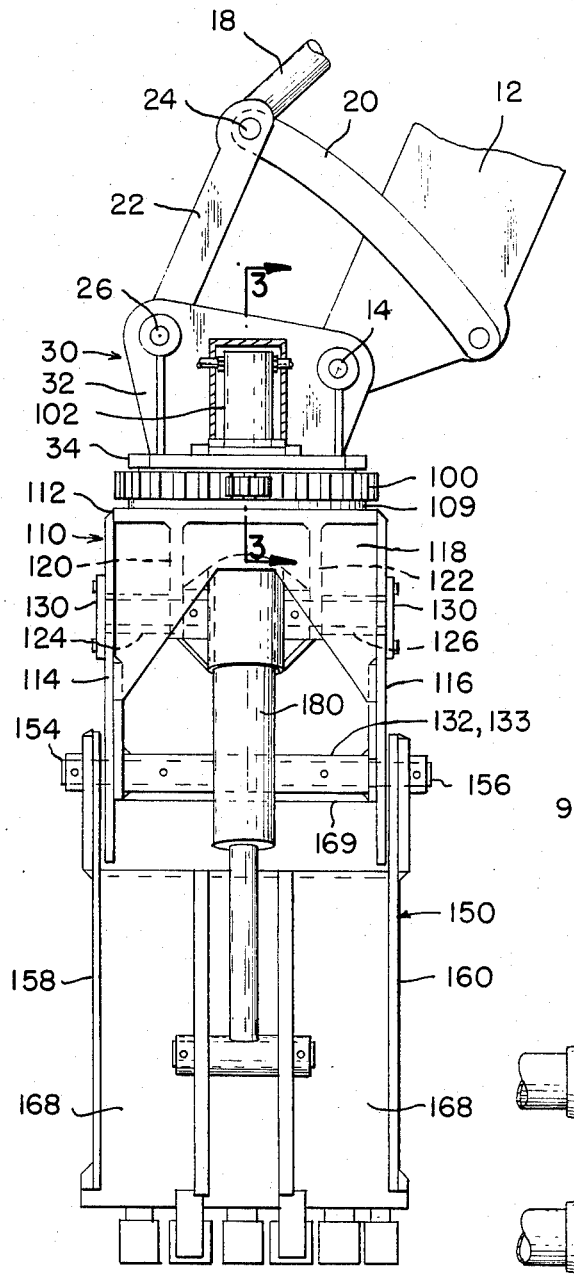
FIG. 4
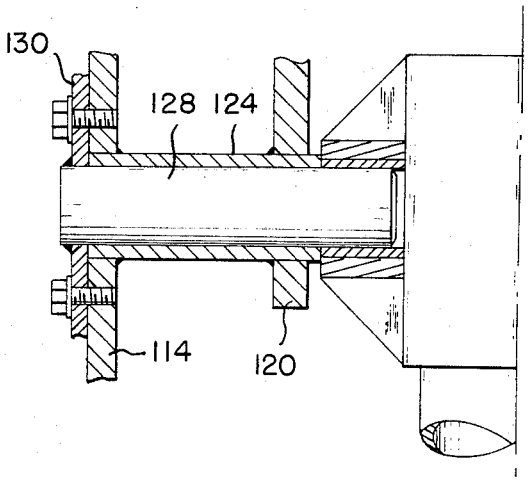
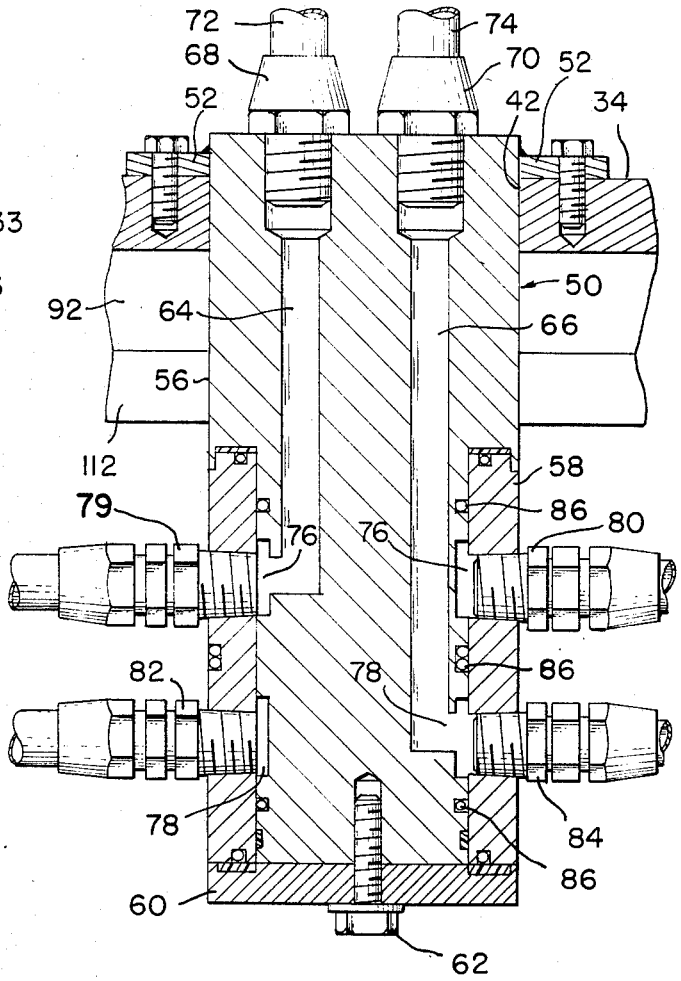
FIG. 3

ARTICULATING CLAM TYPE GRAPPLE FOR A BACKHOE

BACKGROUND OF THE INVENTION

The invention relates in general to the field of backhoe clam-type grapples and more particularly to a grapple connector head and mounting assembly for positive manipulation and control of the grapple jaws.

Those skilled in the art appreciate that known bucket or clam attachments for backhoes have many disadvantages. In some types, one jaw is fixed so that the clam shell type grapple is limited in the manner in which it can handle materials such as rocks, dirt, under brush, logs, tree stumps and the like. Some types of grapples are merely suspended from the end of the boom or the dipper stick and thus lack positive control in at least one dimension. Other types of clam shell buckets or grapples are too complicated and therefore too expensive or impractical for the use to which they are to be put. In any event, they fail to give the backhoe operator the versatility and flexibility which are so necessary to saving and reduction of operator and machine time.

The following U.S. Patent Numbers are cited for their relation to the subject matter of this invention but are not considered pertinent to the teachings of this invention. They are: U.S. Pat. Nos. 2,725,996; 2,788,143; 3,510,017; 3,807,589; 3,881,263; 3,920,137; and 4,047,313.

SUMMARY OF THE INVENTION

The invention comprises a connector or mounting head which attaches to the dipper stick of a backhoe and the bucket linkages or Crowder arms. A mounting assembly is connected to the connector head for rotatable movement thereon. A hydraulic motor is provided to turn the mounting assembly and the grapple jaws through a continuous 360° of rotation. Cylinders are mounted on the mounting assembly for opening and closing both grapple jaws. In addition, controls are installed for controlling the rotational movement of the grapple and for the opening and closing of the jaws.

Accordingly, it is among the objects, features and advantages of the invention to provide a grapple which can exactly locate rocks, logs, pipe and the like and which has more flexibility and versatility in digging and ditching. The invention allows the operator to put the full pressure of the boom and dipper stick down on the grapple since it is positively mounted rather than suspended. The grapple enables a backhoe to clean a larger strip without moving the backhoe and to do it in rectangular work areas to the side of the backhoe as opposed to the triangular stirrups to which many known grapples are confined. The device is simple and relatively inexpensive and very rugged and durable. The grapple greatly facilitates and shortens the time involved in removing tree stumps, setting rip wrap or rockeries using large and very heavy rock. The grapple enables the operator to work at greater distances from the machine than has heretofore been possible. It only requires two additional control levers in the backhoe cab for full versatility and flexibility in its movement.

BRIEF DESCRIPTION OF THE DRAWINGS

FIG. 2 is also an elevational view showing additional details of the connector head and mounting assembly with respect to dipper stick and cylinders;

FIG. 3 is a partial elevational cross-section taken along the line 3—3 of FIG. 2 showing details of the hydraulic control manifold;

FIG. 4 is a partial cross-section view of the four pin mounts for the grapple jaws;

DESCRIPTION OF PREFERRED EMBODIMENT

Figure 1:
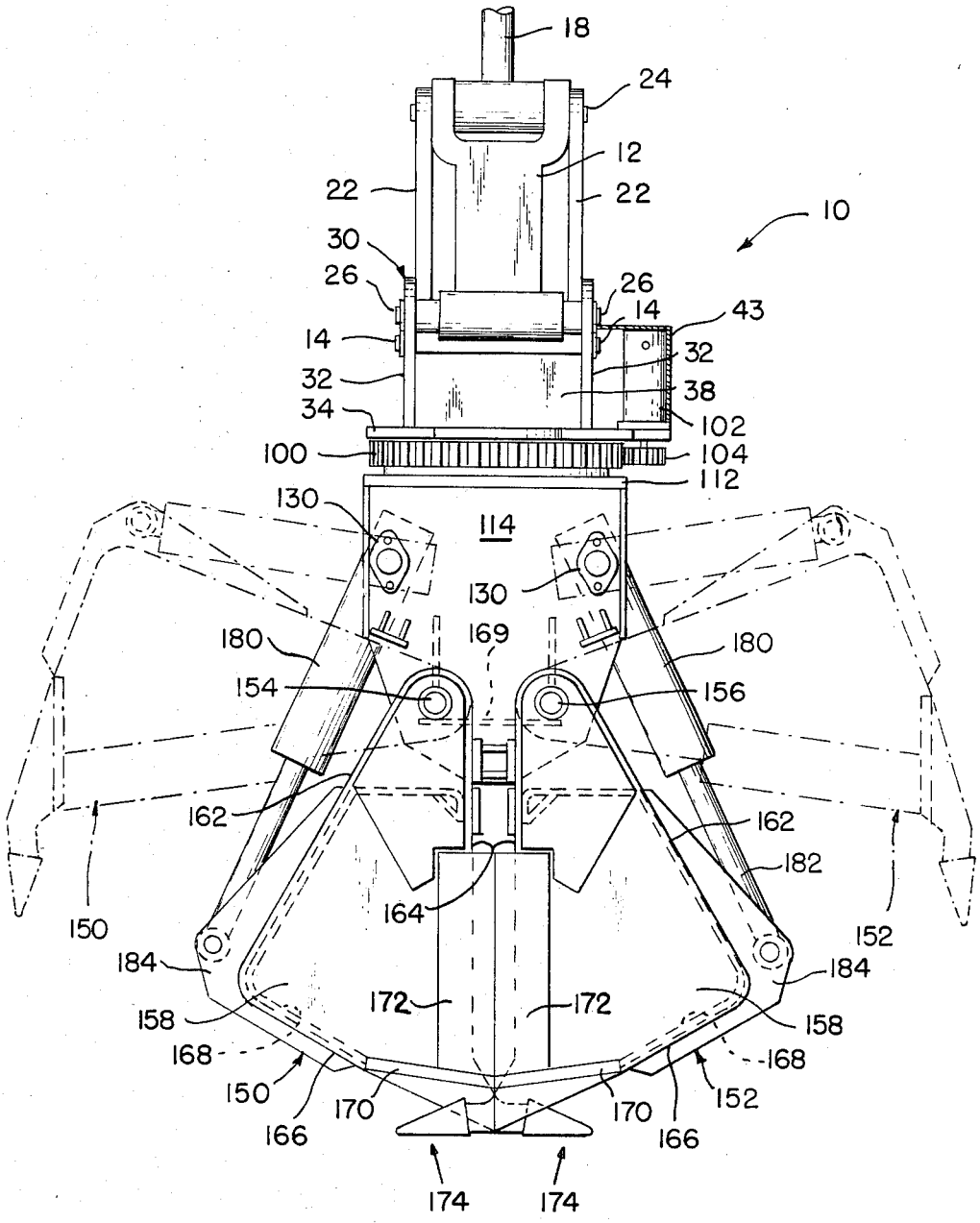
FIG. 1 is a side elevation view of the grapple of this invention showing its connection to the backhoe dipper stick and bucket cylinder piston arm.
Figure 5:
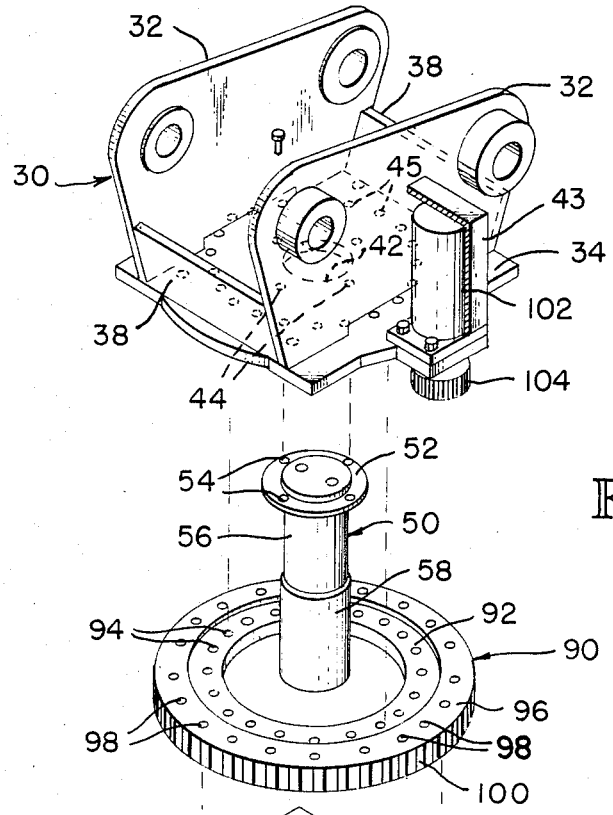
FIG. 5 is an exploded view of the connector head and mounting assembly.
Figure 6:
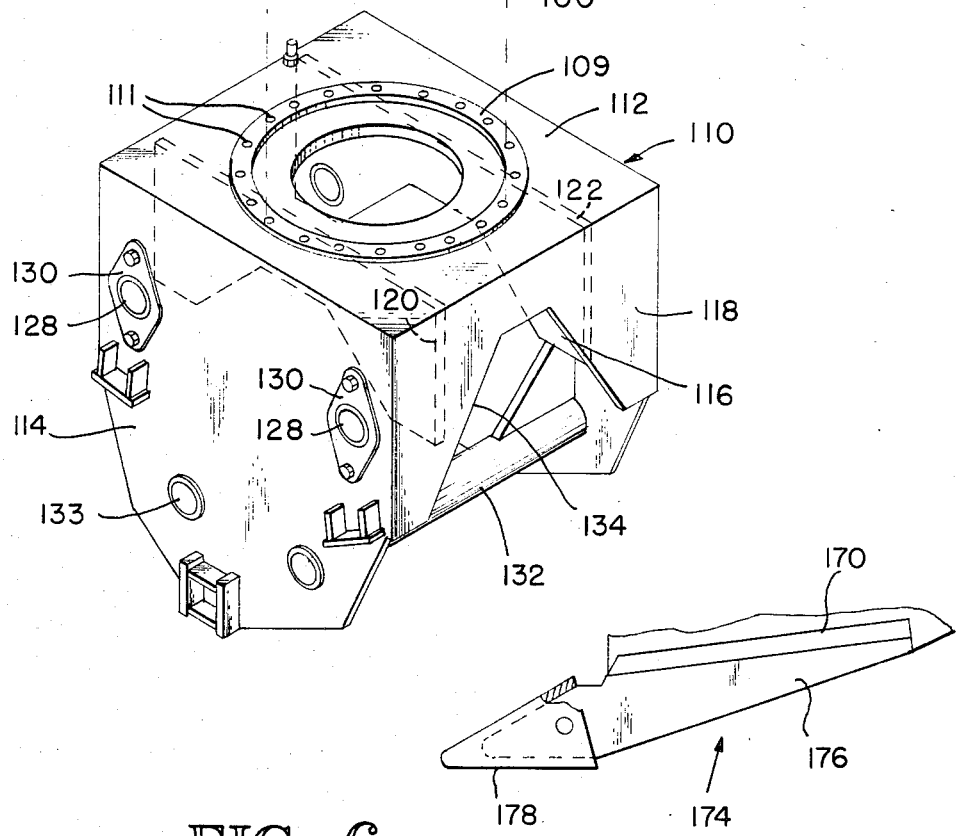
FIG. 6 is a side elevational view showing a jaw tooth.

Referring now to the drawings, it will be seen that the grapple, generally designated by 10, is connected to the backhoe dipper stick 12 by a main pin connection 14 and that it is also connected to the tool cylinder piston rod 18 through linkages 20 and 22, and through piston rod pin 24 and connector pin 26. The connector head, generally designated by the number 30, is comprised of two spaced apart side plates 32 which at their upper ends are spaced apart a predetermined distance to receive between them the dipper stick 12. As can be seen, the side plates 32 being disposed generally parallel to each other, are connected to a connector head base plate 34. Base plate 34 may take any shape but as can be seen in FIG. 5 is shown to be generally rectangular. The side plates 32 are shaped so that the pin connections 14 and 26 are separated and such that the connection for pin 26 is higher than the connection for main pin 14, again as best seen in FIGS. 1 and 2. Strengthening plates 38 extend between side plates 32 below the pin connections and generally occupy the area between the side plates and also define an inside area. Centrally located on base plate 34 is opening 42. Bolt holes 44 are located equally spaced from each other close to opening 42 and concentrically surrounding opening 42 and holes 44 are a series of holes 45 which are formed in base plate 34 for purposes to be explained hereinafter.

Referring now to FIGS. 3 and 5, it will be seen that a hydraulic swivel valve assembly, generally designated by the number 50, is an elongated generally cylindrical component having at its upper end a mounting flange 52 with spaced apart bolt openings 54 which coincide with the openings 44 in plate 34. The cylindrical body 56 extends downwardly from the mounting flange 52 to a steel sheet 58 rotating on wear rings or which could be a brass swivel bearing. A retainer 60 and cap screw 62 hold swivel bearing 58 on the valve body 56. Hydraulic passages 64 and 66 extend through the swivel valve body from couplings 68 and 70 which in turn are connected to hydraulic pressure supply lines 72 and 74. When one line 72 or 74 is under pressure then the other will function as a fluid return line. Within the steel swivel bearing 58 are annular passages 76 and 78 which in turn open to inlet-outlet supply fittings 79 and 80. Annular supply passage 76 is connected to supply passage 64. Annular supply groove 78 is connected to fittings 82 and 84 and also connect to supply passage 66. Seal means 86 are provided above and below each of the annular passages 76 and 78 to prevent leakage of the high pressure hydraulic fluid as it is being directed to the grapple cylinders. The hydraulic swivel valve enables the grapple to be rotated through a full 360° continuous circle without the concern of over-extending hoses or other hydraulic lines or without having to reverse the direction of rotation because of a limit on rotational movement.

It will be seen by reference to FIGS. 2 and 5 that a combination gear and bearing, generally designated by the number 90, attaches to the connector head 30 and the mounting head 110 which will be described in more detail hereinafter. The drive gear and bearing assembly 90 has a bearing portion 92 with bolt holes 94 therein which align with openings 45 in the base plate 34. In rotatable relation to the bearing portion 92, is ring gear portion 96 with openings or bolt holes 98 and around the outside are gear teeth 100. It will be appreciated that the gear teeth may if desired, be on the inside of the ring gear in which case the bearing portion would be around the outside. Details of the ring gear and bearing assembly 90 are not shown in detail since such components are known prior art.

A hydraulic motor 102 is mounted on the outside of plate 34 with the shaft thereof extending through an opening in plate 34 at the end of which shaft is mounted a pinion gear 104 which meshes with ring gear teeth 100. Appropriate hydraulic connections are made to the hydraulic motor 102 as shown in FIG. 2. Again, it is to be appreciated that if desired, the bearing and gear assembly may be of the type which would put the ring gear inside and the bearing on the outside in which case hydraulic drive motor 102 would be mounted within the space between side plates 32.

The mounting head assembly which will now be described, is generally designated by the number 110, and is best shown in FIGS. 1, 2 and 5 and is basically a box-shaped component having a top wall 112, side walls 114 and 116 and end walls 118. Side walls 114 and 116 extend downwardly below the lowest point of the end walls 118 as can best be seen in FIGS. 2 and 5. Mounted within the mounting head assembly and depending from the top plate 112 and disposed between and parallel to side plates 114 and 116 are interior support walls 120 and 122 both of which are equally spaced from their related side wall 114 or 116.

Extending between side plate 114 and support plate 120 as shown in FIG. 4 is pin support tubing 124 and between side plate 116 and interior mounting plate 122 is tubing 126. Tubings 124, see FIG. 4, and 126 receive pin assemblies 128 which are welded to plate 130 which in turn can be bolted to side plates 114 and 116. The pins 128 are designed to be the removable pivot means for the grapple jaw cylinders as can be seen in FIGS. 1 and 2. It will be noted that ring gear 96 secures to upper plate 112 of the mounting assembly by virtue of a concentric series of bolt holes 111 which correspond with bolt holes 98 in the ring gear itself, thus making the mounting assembly 110 rotatably movable with respect to the connector 30 and the bearing 92.

Located lower down on side plates 114 and 116 and extending therebetween are pin mounting or pin holding tubes 132 and 133 which receive pins on which the grapple jaws are supported and which will be explained in greater detail hereinafter. Note that the end walls 118 have cut-away sections therein which are in the form of downwardly facing V-shaped notches 134 which enable the mounting end of the cylinders to extend from within the mounting assembly to the connecting point on the back of the grapple jaws.

The grapple jaws, generally designated by the numbers 150 and 152, are pivotally connected to the mounting assembly 110 by pins 154 and 156 respectively which are received in tubes 132 and 133 with hardened bushings. The grapple jaws are generally identical structures having side walls 158 and 160, the side walls having a back edge 162, a front or inside edge 164, and a bottom edge 166, which together define the side walls. The side walls 158 and 160 are roughly triangular in shape as can best be seen in FIG. 1. The narrow upper end of the side walls of the grapple jaws are attached to the mounting assembly 110 by pins 154 and 156 extending through the tubes 132 and 133. A closure plate 168 shown in dotted lines covers generally all of that part of the grapple between the side walls beginning near the inside edge 164 and extending to the back and then down to the bottom edge so the jaws are enclosed. Cutting plates 170 extend from the closure plates and complete the enclosure of the jaw interiors. Edge plates 172 are shown to be attached to the side walls 158 and 160 to close the gap between front edges 164.

Grapple teeth generally designated by number 174, have lugs 176 which are attached to cutting plate 170 for receiving replaceable teeth caps 178 which are secured onto lugs 176 by removable pins. Thus, when the teeth caps 178 are worn, they can be knocked off with a sledge hammer and new teeth caps fitted on. It will be appreciated by reference to the drawings that teeth on the opposed jaw portions are staggered so as to prevent interference in jaw closing. The grapple jaw sections are operated by cylinders 180 having piston rods 182. The cylinder ends attach pivotally to the removable pins 128 described above and the piston rods themselves pivotally attach to rigidizing brackets 184 on the grapple back wall.

What is claimed is:

1. A grapple device for attachment to a backhoe dipper stick and tool cylinder or the like, comprising:

(a) a connector head connected for controlled positive movement attachment to said dipper stick and tool cylinder and including a connector head base plate having top and underside surfaces, said connector head base plate having supported thereon motor driven pinion gear means, (b) a combination gear and bearing assembly having a first portion thereof secured to said underside surface and supported by said base plate of said connector head, and a second portion thereof rotatably supported on said first portion and adapted to receive a rotatable mounting assembly, said second portion having drive gear means for being engaged and rotatably driven by said motor driven pinion gear means on said base plate, (c) a mounting assembly mounted on said second portion of said gear and bearing assembly, said mounting assembly including a top wall which is connected to said second portion of said gear and bearing assembly and further including spaced apart side walls depending from said top wall, said side walls being substantially parallel and of approximately the same configuration and defining between them a working area which is generally open between the ends and at the bottom of said side walls, said working area including grapple jaw connecting means and hydraulic cylinder connecting means above said grapple jaw connecting means, (d) a pair of grapple jaw means pivotally secured to said grapple jaw connecting means such that said jaw means can be pivoted together for a closed position and pivoted apart for an open position, said grapple jaw means each being operatively moved by hydaulic cylinder means connected between said hydraulic cylinder connecting means and said grapple jaw means, and (e) hydraulic manifold means supported on said base plate and extending downwardly through an opening therein and through said gear and bearing assembly into said working area to provide hydraulic fluid for said hydraulic cylinder means.

2. The grapple device according to claim 1 and wherein said grapple jaw connecting means are located near the bottom of said mounting assembly side walls.

3. The grapple device according to claim 1 and in which said first portion of said gear and bearing assembly is radially inwardly of said second portion.

4. The grapple device according to claim 1 and in which said grapple jaw connecting means are located interiorly of said mounting assembly side walls.

5. The grapple device according to claim 1 and in which said hydraulic cylinder connecting means are located within said working area.

6. The grapple device according to claim 1 and in which said manifold means include a main manifold portion which is nonrotatable and a rotatable portion to which are connected hydraulic hose means for conveying hydraulic fluid to and away from said hydraulic cylinder means.

7. A grapple device for attachment to a backhoe dipper stick and tool cylinder or the like, comprising:

(a) a connector head connected for controlled positive movement attachment to said dipper stick and tool cylinder and including a connector head base plate, said connector head base plate having supported thereon motor driven pinion gear means, (b) a combination gear and bearing assembly having a first portion thereof secured to and supported by said base plate of said connector head, and a second portion thereof rotatably supported on said first portion and adapted to receive a rotatable mounting assembly, said second portion having drive gear means for being engaged and rotatably driven by said motor driven pinion gear means on said base plate, (c) a mounting assembly mounted on said second portion of said gear and bearing assembly, said mounting assembly including a top wall which is connected to said second portion of said gear and bearing assembly and further including spaced apart side walls depending from said top wall, said side walls defining between them a working area which is generally open between the ends and at the bottom of said side walls, said working area including grapple jaw connecting means and hydraulic cylinder connecting means, (d) a pair of grapple jaw means pivotally secured to said grapple jaw connecting means such that said jaw means can be pivoted together for a closed position and pivoted apart for an open position, said grapple jaw means each being operatively moved by hydraulic cylinder means connected between said hydraulic cylinder connecting means and said grapple jaw means, and (e) hydraulic manifold means supported on said base plate and extending downwardly throgh an opening therein and through said gear and bearing assembly into said working area to provide hydraulic fluid for said hydraulic cylinder means.

8. The grapple device according to claim 7 and wherein said grapple jaw connecting means are located near the bottom of said mounting assembly side walls.

9. The grapple device according to claim 8 and in which said grapple jaw connecting means are located interiorly of said mounting assembly side walls.

10. The grapple device according to claim 9 and in which said hydraulic cylinder connecting means are located within said working area.

11. The grapple device according to claim 7 and in which said first portion of said gear and bearing assembly is radially inwardly of said second portion.

12. The grapple device according to claim 7 and in which said manifold means include a main manifold portion which is nonrotatable and a rotatable portion to which are connected hydraulic hose means for conveying hydraulic fluid to and away from said hydraulic cylinder means.

* * * * *